United States Patent [19]

Samuelson

[11] 4,016,029

[45] Apr. 5, 1977

[54] PROCESS FOR DELIGNIFYING AND BLEACHING CELLULOSE PULP

[75] Inventor: Hans Olof Samuelson, Goteborg, Sweden

[73] Assignee: Mo och Domsjo Aktiebolag, Ornskoldsvik, Sweden

[22] Filed: Mar. 6, 1975

[21] Appl. No.: 555,752

[30] Foreign Application Priority Data

Mar. 14, 1974 Sweden ..... 7403452

[52] U.S. Cl. ..... 162/31; 8/111; 162/63; 162/65; 162/72; 162/76; 162/79; 162/80; 162/90

[51] Int. Cl.[2] ..... D21C 9/10; D21C 11/14

[58] Field of Search ..... 162/65, 63, 90, 72, 162/76, 80, 31, 70, 79; 8/111; 210/63

[56] References Cited

UNITED STATES PATENTS

| | | | |
|---|---|---|---|
| 2,673,148 | 3/1954 | Harris | 162/65 |
| 2,811,518 | 10/1957 | Mitchell et al. | 162/65 X |
| 2,926,114 | 2/1960 | Grangaard et al. | 162/65 X |
| 3,207,572 | 9/1965 | Saul | 162/31 X |
| 3,654,070 | 4/1972 | Pradt et al. | 162/65 X |
| 3,701,712 | 10/1972 | Samuelson et al. | 162/65 |
| 3,759,783 | 9/1973 | Samuelson et al. | 162/65 X |
| 3,764,464 | 10/1973 | Samuelson | 162/65 |

OTHER PUBLICATIONS

Jamieson et al., "Oxygen–Sodium Bicarbonate Pulping of White Birch", Tappi Journal, vol. 58, No. 2, 2–1975, pp. 68–71, 162–165.

Casey, Pulp & Paper, vol. I, 1960, p. 457.

*Primary Examiner*—Robert L. Lindsay, Jr.
*Assistant Examiner*—Arthur L. Corbin

[57] ABSTRACT

A process is provided for delignifying and bleaching cellulose pulp, which comprises carrying out the delignification and bleaching with oxygen and alkali in the presence of sodium bicarbonate, while removing carbon dioxide from the gas phase as required to maintain a carbon dioxide partial pressure within the range from about 0.001 to about 3 bars, thereby improving the selectivity of the delignification and bleaching.

23 Claims, No Drawings

PROCESS FOR DELIGNIFYING AND BLEACHING CELLULOSE PULP

The conversion of raw lignocellulosic material to unbleached and then to bleached pulp requires an extremely complex and intricate series of chemical reactions and physical process, usually requiring at least two stages, in which different chemical reactions are involved. The first of these stages is referred to as pulping, and the second stage as bleaching. Although both these stages include delignification, they differ significantly. e Rydholm in Pulping Processes has pointed out that the common purpose of all chemical pulping processes is to achieve fiber liberation by delignification, and they can be classified according to their different ways of achieving this. Reactions with the carbohydrates occur at the same time, and dissolution of certain amounts of the carbohydrates and chemical modification of the remainder determine the quality of both dissolving and paper pulps, and are therefore controlled accordingly. Dissolution of the extraneous components of wood is important to pulp quality. Inorganic side reactions occur, which are of importance not only for the regeneration of the pulping chemicals, but indirectly for the reactions with the wood during the cook.

Alkaline delignification results in alkaline hydrolysis of the phenolic ether bonds, whereby lignin is rendered soluble in alkali. Sulfidation by hydrosulfide in the Kraft process may both accelerate the cleavage of phenolic ether bonds and cause direct cleavage of alkyl ether bonds, as well as protect alkali-sensitive groups from a condensation which could retard the delignification. Sulfonation of benzyl alcohol and alkly ether groups in the sulfite process renders the lignin water-soluble; the cleavage of the alkyl ether bonds, which keep the initially formed lignosulfonates bound to the wood, occurs by sulfitolysis or acid hydrolysis. At the same time sulfonation of the reactive groups prevents their partaking in condensation reactions. Neutral sulfite pulping, which involves less delignification, utilizes sulfonation of certain groups in the lignin to hydrophilic sulfonates, the dissolution of which is effected by unknown reactions, which may involve both sulfitolysis and hydrolysis. Finally, nitration and chlorination of lignin, used in some minor pulping processes, together with some oxidation, as in oxygen-alkali pulping, cause changes at the aromatic nuclei of lignin, which lead to decomposition of the lignin macromolecules to smaller fragments, which are soluble in water or alkali.

In all delignification, and especially the delignification that occurs during pulping, one side reaction of lignin is most undesirable, its self-condensation, which occurs in both acid and alkaline medium, rendering the lignin less soluble and dark in color, which darkens the color of the pulp. Chemical pulping cannot entirely avoid lignin condensation, and the lignin remaining in the pulp after cooking is more or less condensed. The purpose of the bleaching reactions in the bleaching stage is to cause such degradation of these colored lignin condensation products that they can be dissolved, and thus improve the color of the pulp. To this extent, bleaching is a delignification, but it is a different delignification, because at this stage the lignin is in a different form.

Although in most pulp uses lignin is an undesirable or at best inert component of the pulp, no preparation of unbleached or bleached pulp aims at complete delignification. This is primarily because of the unavoidable reactions with the carbohydrates during the delignification. These reactions become particularly serious towards the end of the cook, when the rate of delignification is slow, because of the small amounts of lignin remaining and their high degree of condensation of inaccessibility. When pulps with a high content of hemicellulose are desired, considerable amounts of lignin are left in the pulp. For unbleached pulps the upper limits are set by the brightness and brightness stability required, as well as the extent to which lignin can be allowed to impair the beating and strength properties of the pulp. In the case of bleached pulps the cost of bleaching agents is the limiting factor.

The alkaline degradation of carbohydrates starts at the aldehydic end groups and proceeds along the chains in a sort of peeling reaction with conversion of the sugar monomers to saccharinic and other hydroxy acids. This reaction occurs fairly rapidly at 100° C and therefore precedes delignification. At higher temperatures there occurs a direct alkaline hydrolysis of the glycosidic bonds, which also affects the more crystalline parts of the carbohydrates. This reaction not only leads to new losses of yield by peeling reactions starting at the freshly formed aldehydic groups, but also to a shortening of the cellulose chains and a deterioration of the strength properties of the pulp. Another reaction, involving an intramolecular rearrangement, causes a stabilization of the carbohydrate molecules under formation of a carboxyl end group.

The selectivity of the pulping and bleaching chemicals with respect to delignification determines the yield of the pulping and bleaching process and to some extent the resulting pulp properties. In the sulfite process, sulfonation and acid hydrolysis contribute to delignification, and acid hydrolysis to the carbohydrate degradation and dissolution. In the Kraft process, sulfidation and alkaline hydrolysis contribute to delignification, and alkaline peeling and hydrolysis to the carbohydrate degradation. The delignification proceeds more rapidly in the sulfite cook than in the Kraft cook, and lower temperatures can therefore be used in the former, which is fortunate because the hydrolysis of the glycosidic bonds of the carbohydrates occurs much more rapidly in acidic than in alkaline medium. Alkaline peeling reactions, on the other hand, require lower termperature than the alkaline delignification, and they unavoidably decrease the carbohydrate yield, to a degree which depends on both chemical and physical changes in their structure. Accessibility phenomena improve the selectivity of lignin removal.

In recent years, the cellulose pulp industry has become increasingly interested in pulping and bleaching methods which reduce pollution of the environment and minimize pollutant emission and wastes. As a result, much attention has been given to the bleaching of chemical and semi-chemical cellulose pulps with oxygen in an alkaline medium in order to dissolve lignin. The oxygen treatment is carried out at an elevated temperature, of the order of 100° C, and does not normally require more than 1 hour. The alkali used is sodium hydroxide, and the amount required is of the order of 4 to 5 percent NaOH, based on the dry pulp. It is possible to obtain a good reduction in lignin content in this way, but unfortunately, at the same time hemicellulose is also dissolved, and a significant decomposition of the cellulose takes place, as evidenced by a lower viscosity value. Selectively is thus impaired. Also, the strength properties of papar manufactured from such treated paper are poor.

It has been proposed (U.S. Pat. No. 3,384,533 dated May 21, 1968, to Robert et al) that the process be improved by carrying out the treatment with oxygen and sodium hydroxide in the presence of a metal carbonate, such as barium carbonate, calcium carbonate, magnesium carbonate or zinc carbonate, in an amount within the range from about 0.5 to 3% by weight of the pulp. Of these chemicals, magnesium carbonate gives the best results, when in an amount of approximately 1% by weight of the pulp. However, magnesium carbonate is quite expensive, and the treatment is costly. Calcium carbonate, which is cheaper, is much less effective. In the case of all of these salts, the difficulty is that a powdered water-insoluble material must be charged to and mixed with the aqueous cellulose pulp system, and it is accordingly hard to obtain and maintain a homogeneous mixture, with uniform effect.

In accordance with U.S. Pat. Nos. 3,652,385 and 3,652,386, dated Mar. 28, 1972 to Samuelson et al, a process is provided for treating cellulosic materials with alkali in the presence of oxygen, and in the presence of a complex magnesium salt, such as a magnesium salt of an organic acid having from two to about twelve carbon atoms and either one carboxylic acid group and an alpha or beta hydroxy group such as an aliphatic alpha- or beta-hydroxycarboxylic acid, or a mixture of a magnesium salt and an aliphatic alpha- or beta-hydroxycarboxylic acid or salt thereof, or two or more carboxylic groups and no or from one to ten hydroxyl groups such as a dicarboxylic acid or a mixture of a magnesium salt and such acid or salt thereof. In this process, it has been found that it is possible in one stage to reduce the lignin content by more than 50% without causing deleterious degradation of the cellulose, or appreciable loss of hemicellulose. In fact, the dissolution of hemicellulose can be controlled so as to be insignificant or appreciable, as desired, so that the process is also applicable to hemicellulose dissolution. At the same time, these compounds are inexpensive, and since they are water-soluble, they can be added in solution form, and form a homogeneous aqueous alkaline system in which the cellulose pulp is suspended.

The process is particularly advantageous in the alkaline treatment of lignin-containing wood cellulose in the presence of oxygen, gas or air, for the purpose of removing lignin. This process is referred to in the art as alkaline oxygen gas bleaching. It is also applicable to the controlled dissolution of hemicellulose in cellulose pulps, either during or after delignification.

It is customary today when bleaching cellulose pulp with alkali and oxgen to use sodium hydroxide as the alkali. However, the use of other alkali has been proposed.

Watanabe, U.S. Pat. No. 3,251,730, dated May 17, 1966, discloses a method in which the pulp, subsequent to being saturated with a sodium carbonate solution and pressed to a pulp concentration of between 20 and 66.7%, is treated with oxygen at a temperature below 100° C, preferably 80° C. Under these conditions, the bleaching reactions cease practically completely when the pH has fallen to approximately 9.5. This means that sodium carbonate supplied to the system is converted to sodium bicarbonate.

Richter, U.S. Pat. No. 1,869,432 and Mitchell and Schlosser, Swedish Patent Specification No. 152 116 describe a process in which depolymerization of the cellulose is intentially caused by means of oxygen, in conjunction with hot alkali refinement. As the alkali, sodium carbonate can be used, but the Examples in these patents use only sodium hydroxide as the alkali. Under these conditions, also, sodium carbonate would be converted to sodium bicarbonate, and no carbon dioxide would be generated.

However, this is not a bleaching process in the usual sense, but an oxidative depolymerization of cellulose, so as to obtain a low-viscosity pulp suitable for making cellulose derivatives. Depolymerization is directly harmful to pulp properties in most cases. It is primarily an extensive depolymerization and a heavy loss of hemicellulose that, in the case of oxygen bleaching of paper pulp with sodium hydroxide as an active alkali, prevents the delignification from being continued beyond the limit where approximately 50% of the lignin is removed, even when inhibitors such as magnesium compounds are present to retard the attack on the carbohydrates.

Intensive studies have been made in an attempt to find effective inhibitors, but even with the best available inhibitors, it is not possible to continue the delignification beyond the 50% limit in the case of high-grade paper pulps.

Grangaard and Saunders, U.S. Pat. No. 3,024,158, subject cellulose pulp to an oxygen treatment in a suspension in a sodium bicarbonate solution to improve the resistance of the bleached pulp to loss of brightness due to ageing (brightness reversion). The treatment is effected at a pulp concentration of from 2 to 15% using an enormous addition of sodium bicarbonate, from 20 to 40% $NaHCO_3$ in the case of unbleached sulphate pulp, and 20% $NaHCO_3$ in the case of wood cellulose bleached by conventional methods.

In the bleaching of wood cellulose with the use of oxygen and sodium carbonate, at most half of the added quantity of sodium carbonate is used to neutralize organic acids formed during said process, while the remainder is converted substantially to sodium bicarbonate, and is recovered as such at termination of the bleaching process. When sodium bicarbonate is used as the alkali, only an extremely small proportion of the sodium bicarbonate is apparently consumed; the major proportion thereof remains unchanged during the treatment and is recovered upon termination of the process.

Worster and Pudek, Swedish Utlaggningsskrift No. 11,058/1971, proposed an oxygen-sodium carbonate treatment of semi-chemical pulp to delignify and bleach the pulp.

It has been known for many years that wood can be digested to form cellulose pulp by using oxygen gas in the presence of strong aqueous alkali such as sodium hydroxide. The oxygen gas serves as an oxidant which in the presence of the aqueous alkaline liquid phase attacks the lignin of the wood, and converts it into soluble degradation products which dissolve in the alkaline digestion liquor.

Harris U.S. Pat. No. 2,673,148 dated Mar. 23, 1954, proposed an oxygen digestion process using quite high oxygen pressures, of the order of at least 800 psi. This was thought necessary in order to obtain and maintain a sufficiently high oxygen concentration in the digestion liquors. This is one of the serious problems in oxygen digestion processes due to the fact that oxygen is a gas and not capable of being solubilized in the digestion liquor by the expedients employed up to now. However, the results obtained in this process were not satisfactory.

Grangaard and Saunders, the U.S. Pat. No. 2,926,114, dated Feb. 23, 1960, stated that oxygen prior to 1957 had been used both at low and at high oxygen pressures. However, at low pressures, the pulping was inadequate, and the process had to be used only as a single stage in a multiple stage pulping process, using more conventional pulping chemicals to complete the pulping. At the high pressures, the pressures are so high, large volume batch digesters cannot be readily constructed to withstand them. Grangaard el al proposed a digestion at pH 7 to 9 over at least a major portion of the cooking time, ranging up to 9.4 at the end of the cook, under oxygen pressure of 40 to 250 psi, using conventional batch digesters. The pH is maintained within the desired range by a buffer such as sodium bicarbonate, or by continuous addition of alkali such as sodium hydroxide or sodium carbonate, to neutralize free acids formed throughout the digestion. However, the disadvantages are:

1. An extremely high oxygen consumption.
2. It is difficult to control the process, and a nonuniform pulp is obtained.
3. A high consumption of sodium bicarbonate, and no method is suggested for the recovery of bicarbonate.

A recent investigation of the oxygen digestion process by J. C. Lescot, "Essais de Delignification de Bois Feuillus par l'Oxygene en Milieu Alcalin" (Ph.D. Thesis, University of Grenoble, France, Oct. 27, 1967), resulted in the conclusion that alkaline oxygen digestion was not feasible, since the difficulties of impregnation were important. The author reported that a predigestion with other chemicals was necessary before the delignification with oxygen-alkali.

U.S. Pat. No. 3,764,464, patented Oct. 9, 1973 to Samuelson, proposed a process for the alkaline oxygen digestion of wood controlled so as to inhibit formation of silvers, as well as to prevent undue degradation, thereby to increase the uniformity of the cellulose pulp, and improve its color and strength properties. In this process, the alkaline digestion liquor comprises alkali metal bicarbonate or carbonate, or both, oxygen gas is provided under pressure to the reaction system, and carbon dioxide that is formed and enters the oxygen phase during the digestion process is separated at least once during the digestion, and preferably either continuously, or from time to time, so as to maintain a high partial pressure of oxygen in the gas phase. The carbon dioxide that is separated can be recovered and used to form alkali metal carbonate, or bicarbonate, or both, and recycled, and since the resulting process is more efficient, this results in greater economy both of alkali and of oxygen.

In accordance with the invention, it has been determined that the selectivity of delignification is improved when the oxygen-alkali bleaching process is effected in the presence of sodium bicarbonate as the alkali in place of all or part of the sodium hydroxide or sodium carbonate, and the partial pressure of carbon dioxide is maintained within the range from about 0.001 to about 3 bars. The resulting pulp has a higher viscosity at a given lignin content, and a higher yield of carbohydrates at a given lignin content. The delignification can be effected more rapidly, and the sodium ions can be used more effectively, than when sodium hydroxide and/or sodium carbonate are used, even though they may give rise to sodium bicarbonate in situ.

The invention accordingly provides a process for delignifying and bleaching cellulose pulp with an oxygen-containing gas in the presence of sodium bicarbonate during all or at least a major portion of the process at an oxygen partial pressure of at least 1 bar, suitably within the range from 1 to about 50 bars, and preferably within the range from about 3 to about 20 bars, at a temperature which during the major portion of the process is within the range from about 100° to about 170° C, suitably from about 110° to about 150° C, preferably from about 120° to about 145° C, while removing carbon dioxide formed during the process and maintaining the partial pressure of carbon dioxide within the range from about 0.001 to about 3 bars, suitably from about 0.03 to about 2 bars, preferably from about 0.05 to about 1 bar, and conveniently within the range from 0.05 to 0.5 bar.

A practical lower limit for the partial pressure of oxygen is approximately 1 bar. Better selectivity is obtained within the range from about 3 to about 20 bars, while a further improvement in respect of selectivity is obtained if the pressure is further raised, although the effect is surprisingly small, in comparison with the effect obtained when digesting wood with oxygen in the presence of sodium bicarbonate. High temperatures result in an increased delignification rate but lead to an impaired selectivity.

The partial pressure of carbon dioxide is selected according to (1) the type of cellulose pulp; (2) the intended use of the pulp; (3) available alkali(sodium hydroxide, carbonate, bicarbonate); (4) available apparatus; and (5) recovery of chemicals. The following will assist in the selection of a suitable carbon dioxide partial pressure.

The rate of delignification and bleaching decreases with increasing carbon dioxide content in the gas phase. A marked reduction in the bleaching rate is noted at a carbon dioxide partial pressure of 0.2 bar. At a higher carbon dioxide partial pressure than 3 bars, the bleaching time becomes unrealisitcally long, unless the delignification temperature is so high that the pulp becomes unsuitable for use in paper.

The number of carbonyl groups in relation to the number of carboxyl groups in the bleached pulp increases with increasing carbon dioxide content in the gas phase. A high copper number is thus obtained at a high carbon dioxide content. This is normally a disadvantage.

In the case of hardwood pulp, the yield is reduced if the carbon dioxide partial pressure is excessively low, for example below 0.05 bar, during a substantial portion of the oxygen treatment process at high temperature. This also applies to both softwood and hardwood sulphite pulps. On the other hand, softwood sulphate pulps, for example, are relatively insensitive in this respect.

The selectivity during delignification, here defined as the viscosity of the bleached cellulose pulp at a certain Kappa number, is strongly affected by the carbon dioxide partial pressure. With tests carried out at a constant dioxide pressure during the entire process, the best results have been obtained at a partial pressure within the range from about 0.05 to 0.5 bar. In order to find the optimum partial pressure, account must be taken of the type of cellulose pulp used, and of the catalysts and degradation inhibitors present.

In order to optimize the properties of the bleached pulp and the economy of the process, the carbon dioxide partial pressure can be maintained at different levels during different stages of the delignification and bleaching process. It is particularly advantageous to effect the process of the present invention continuously, it being suitable to maintain different carbon dioxide partial pressures in different zones of the system.

The first portion of the delignification process can be at a low carbon dioxide partial pressure, from 0.001 to 0.1 bar, while the pressure during the latter portion is allowed to rise to from 0.1 to 0.5 bars, for example 0.5 bar. Such a pattern with varying carbon dioxide pressure in different stages of the process affords noticeable advantages in the quality of the pulp and reduced operating costs.

To facilitate the control of the process, and to enable a high-grade and uniform pulp to be produced, the course taken by the bleaching process is suitably monitored from determination of the carbon dioxide content or the partial pressure of the carbon dioxide gas at one or more positions in the system. These determinations can be made manually, although they are preferably effected automatically by means of known methods, such as by determining the heat conductivity, or by IR-spectroscopy. The results or the signals emitted from the sensing instruments can be fed to a computer arranged to control the process, or can be used in some other way to control the process.

Uniformity of the bleached cellulose pulp is improved if the cellulose pulp and the oxygen-containing gas are agitated or mixed together or flowed past each other concurrently or countercurrently, so that the transfer of carbon dioxide to the gas phase is improved. Such relative movement is of importance in both continuous and batch processes. For example, the cellulose pulp can flow down against an upward flow of gas in a column or tower, or the pulp can be stirred in agitators in the reactor. It is particularly suitable to flow the oxygen-containing gas through the system, for example, by means of fans, compressors and ejectors.

Since carbon dioxide is liberated in the course of the delignification and bleaching process, it is normally necessary to remove carbon dioxide from the system to maintain carbon dioxide partial pressure within the stated range.

The removal of carbon dioxide from the oxygen-containing gas can be effected either within the system or outside the system. When the carbon dioxide is removed outside the system, the oxygen is conveniently reused for an oxygen bleaching process. Thus, the oxygen can be returned to the system from which the gas mixture was taken.

In accordance with a particularly preferred embodiment, the carbon dioxide is removed either in whole or in part outside the system by forming sodium bicarbonate in situ in cellulose pulp inpregnated with an aqueous alkaline reacting solution, such as sodium hydroxide and/or sodium carbonate. The carbon dioxide containing gas is brought into contact with such cellulose pulp externally of the actual bleaching apparatus, or in a separate absorption zone or zones of said apparatus. This cellulose pulp effectively absorbs carbon dioxide from the gas phase, and the carbon dioxide content of such gas phase is in this way effectively reduced. In the absorption zones, the cellulose pulp can be subjected to a treatment according to the invention for a shorter period of time (or optionally not at all) in comparison with the case in the zone or zones from which the carbon dioxide-containing gas is removed and conveyed to the absorption zone.

The cellulose pulp supplied to the absorption zone has previously been impregnated with an aqueous alkaline reacting solution, preferably a solution containing sodium carbonate and/or sodium hydroxide. However, quantities of sodium bicarbonate built up in the absorption zone in this way are lower than in the system in which the main stage of a process is applied.

The method is particularly effective when the pulp concentration of the impregnated cellulose pulp in the absorption zone is so high that the liquid is completely absorbed by the fibers, e.g. within the range from about 18 to about 60%, suitably from about 20 to about 40%, preferably from about 25 to about 35%. It is an advantage if the pulp, subsequent to being impregnated and optionally pressed, is fluffed in a peg shredder or like apparatus, prior to being passed to the absorption zone.

The temperature in the absorption zone is preferably lower than in the remainder of the system. This can be ensured if the temperature of the pulp being fed to the absorption zone is below that prevailing in the system.

It may also be suitable to maintain a lower gas pressure in the absorption zone or zones than in the remainder of the system.

When sodium hydroxide forms a substantial part of the alkali supplied to the system, it is of particular importance that the absorption process in the absorption zones is effected rapidly, and/or that the absorption temperature is not excessively high. Long contact periods with oxygen under pressure at high temperatures in the absorption zone impair the selectivity of the process.

The pulp in the absorption zone can be subjected to a delignification and bleaching in accordance with the invention, since the pulp contains sodium bicarbonate from absorbed carbon dioxide, and may also have undergone a certain degree of prebleaching.

Consequently, in the case of a continuous system, there need be no sharply defined zones for absorption and the remainder of the system. A long reactor can be provided wherein carbon dioxide is absorbed in a first absorption zone, after which the cellulose pulp enters a zone in which a state of substantially stationary equilibrium can prevail between the carbon dioxide in the gas phase and the carbon dioxide in the cellulose pulp. The cellulose pulp can then be passed through one or more zones in which carbon dioxide is removed from the cellulose pulp.

If, for the purpose of controlling the quality of the pulp, or for obtaining a more rapid delignification and bleaching, it is desired to reduce the partial pressure of the carbon dioxide in one or more of said zones, this can be effected, for example, by absorption of carbon dioxide, or by the addition of an alkali, preferably sodium carbonate. Sodium hydroxide or ammonium hydroxide can also be used.

Another method of removing carbon dioxide from the oxygen-containing gas phase is to remove the gas phase from the system and then remove carbon dioxide, either totally or partially, by absorption in an alkaline reacting aqueous solution or liquor, preferably while the gas is under high pressure. The alkaline-reacting liquor may contain sodium carbonate and/or sodium hydroxide, for practical reasons often in admixture, and sodium bicarbonate and/or sodium carbonate are formed therein. The spent absorption liquor can be recycled to the delignification and bleaching process. If chemical balance in the system requires, all or part of the carbon dioxide can be removed from the spent absorption liquor in accordance with known methods, e.g. by stripping at high temperatures.

The carbon dioxide can also be removed from the oxygen-containing gas by chilling and by absorption in other liquors than those aforementioned. A combination of different methods may be preferred, particularly when the alkali used consists solely os sodium carbonate and sodium bicarbonate.

It is possible to remove carbon dioxide and oxygen-containing gas from the system, and to use the same for wet combustion of waste liquors obtained from cellulose plants, for example the waste liquors obtained from the delignification and bleaching process of the invention.

The solution recovered from the wet combustion process contains primarily sodium carbonate and sodium bicarbonate, and can be used in whole or in part for the delignification and bleaching process. Other alkali sources include sodium hydroxide, sodium carbonate and sodium bicarbonate, optionally recovered in a known manner from waste digestion liquors or waste bleaching liquors in the cellulose plant, or from mixtures thereof. Sulphide-containing liquors can also be used, although it is often advantageous to oxidize the sulphide before supplying white liquor or green liquor to the system.

The oxygen bleaching process according to the invention has been found to afford important advantages both with pulps of low consistency, e.g. concentrations of within the range from about 2 to about 10%, of intermediate consistency, and of consistencies which are so high that the liquid is present substantially within the fibers, within the range from about 18 to about 60%, preferably from about 20 to about 35%. From a technical point of view the process is of easier application when a high pulp consistency is used. Irrespective of the pulp consistency used, or how the consistency is effected and changed in the course of the process, the oxygen gas phase is suitably circulated through the system or within separate zones thereof. These zones may directly merge with one another, as for example in a tower type reactor, or may comprise separate beds of, for example, fluffed pulp, or containers containing a slurry of pulp.

The amount of sodium bicarbonate required in the treatment depends on the quantity of lignin and/or hemicellulose which is desired to remove. Normally, the alkali charge (calculated as $NaHCO_3$) is within the range from about 0.5 to about 12% $NaHCO_3$, based on the weight of the cellulosic material present. If it is desired to dissolve large quantities of lignin and/or hemicellulose during the process, an alkali charge within the range of about 7 to about 12% can be used. When treating a pulp having a low lignin content, in which case a smaller amount of lignin and/or hemicellulose is to be dissolved, the charge can be within the range from about 0.5 to about 7%.

The proportion of hemicellulose dissolved decreases as the amount of sodium bicarbonate is reduced, and accordingly, the amount of both the lignin and the hemicellulose dissolved can be regulated by control of the amount of sodium bicarbonate added.

It may be advantageous to add only a portion of the total quantity of sodium bicarbonate at the beginning of the process, and then add additional sodium bicarbonate as the reaction proceeds. The sodium bicarbonate attacks the lignin preferentially, and by limiting the amount of sodium bicarbonate present at any given time, it is possible to remove the lignin with a minimum of attack upon the cellulose and hemicellulose in the course of the reaction. The desired grade of pulp can thus be controlled by the manner and rate at which the sodium bicarbonate is charged to the system, and the size of the sodium bicarbonate charge, and the reaction time.

The sodium bicarbonate can be combined with the pulp either before, during, or after combination with any degradation inhibitors, and it can be introduced in whole or in part in this way. The mixing with sodium bicarbonate can be effected at the desired reaction temperature, or at a lower temperature, after which the temperature is increased to reaction temperature.

The reaction time required decreases with an increased oxygen gas pressure and the reaction temperature. If the oxygen gas pressure is high, and the reaction temperature is high, the reaction can be complete in rather a short time, for example, 5 minutes. When oxygen gas is employed at atmospheric pressure, treatment times of 10 hours and more can be used. Normally, however, in a commercial process, where a high rate of production per hour is desirable, the reaction times will be within the range from about 10 to about 120 minutes. The reaction time is easy to control, since the reaction halts when the sodium bicarbonate is consumed, and thus the reaction time can be increased or shortened, depending upon the amount of sodium bicarbonate added at any given time, for a given gas pressure and temperature of reaction.

Complexing agents for heavy metals, preferably transition metals, have often been tested as additives in oxygen delignification and bleaching processes using sodium hydroxide as an active alkali. Sometimes contradictory results have been obtained, with positive and negative results reported for the same additive, for example ethylediamine etraacetic acid (EDTA). In the process of the invention, a positive EDTA effect has surprisingly been obtained with completely different types of pulps, mainly sulphite pulps from spruce and aspen and sulphate pulps from pine, birch, eucalyptus and hemlock.

Other types of complexing agents can also be present to advantage. Aliphatic alpha-hydroxycarboxylic acids of the type RCHOHCOOH and the corresponding beta-hydroxycarboxylic acids $RCHOHCH_2COOH$ have the property of forming chelates with metals.

Exemplary alpha- and beta-hydroxy carboxylic acids are glycolic acid, lactic acid, glyceric acid, α, β-dihydroxybutyric acid, α-hydroxy-butyric acid, α-hydroxy-isobutyric acid, α-hydroxy-n-valeric acid, α-hydroxy-isovaleric acid, β-hydroxy-butyric acid, α-hydroxy-yisobutyric acid, β-hydroxy-n-valeric acid, β-hydroxy-isovaleric acid, erythronic acid, threonic acid, trihydroxy-isobutyric acid, and saccharinic acids and aldonic acids, such as gluconic acid, galactonic acid, talonic acid, mannonic acid, arabonic acid, ribonic acid, xylonic acid, lyxonic acid, gulonic acid, idonic acid, altronic acid, allonic acid, ethenyl glycolic acid, and β-hydroxy-isocrotonic acid.

Also useful are organic acids having two or more carboxylic groups, and no or from one to ten hydroxyl groups, such as oxalic acid, malonic acid, tartaric acid, malonic acid, tartaric acid, malic acid, and citric acid, ethyl malonic acid, succinic acid, isosuccinic acid, glutaric acid, adipic acid, suberic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

The polyphosphoric acids are also good complexing agents, and the magnesium salts of these acids are useful in the process of the invention. Exemplary are disodium-magnesium pyrophosphate, trisodium-magnesium tripolyphosphate and magnesium polymetaphosphate.

Especially advantageous from the standpoint of cost are the acids naturally present in waste liquors obtained from the alkaline treatment of cellulosic materials. These acids represent the alkali- or water-soluble degradation products of polysaccharides which are dissolved in such liquors, as well as alkali- or water-soluble degradation products of cellulose and hemicellulose. The chemical nature of these degradation are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$-metasaccharinic acids. Glycolic acid and lactic acid are also probable degradation products derived from the hemicelluloses, together with beta-gamma-dihydroxy butyric acid.

Carbohydrate acid-containing cellulose waste liquors which can be used include the liquors obtained from the hot alkali treatment of cellulose, liquors from sulfite digestion processes, and liquors from sulfate digestion processes, i.e. Kraft waste liquor. The waste liquors obtained in alkaline oxygen gas bleaching or alkaline peroxide bleaching processes can also be used. In this instance, the alkaline liquor can be taken out from the process subsequent to completing the oxygen gas treatment stage, or during the actual treatment process.

Other important and suitable complexing agents are the aminopolycarboxylic acids having the general formula

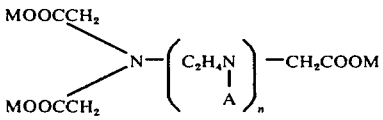

where A is the group $-CH_2COOM$ or $-CH_2CH_2OH$, M is hydrogen or an alkali metal and $n$ is an integer between zero and five. Examples of suitable complexing agents are ethylenediaminetetraacetic acid (EDTA), nitrilotriacetic acid (NTA) and diethylenediaminepentaacetic acid (DPTA) and amines, hydroxyl-containing amines such as mono-, di- and triethanolamine and diamines, triamines, polyamines having complexing properties. Mixtures of these complexing agents may also be used to advantage, as can also the combination of nitrogen-containing and nitrogen-free complexing agents.

Inhibitors known from previous work with oxygen bleaching processes may also advantageously be present during the process. Examples of such inhibitors include different magnesium compounds (U.S. Pat. Nos. 3,652,385 and 3,652,386), formaldehyde or compounds which produce formaldehyde, and iodides. The protective effect afforded by magnesium compounds is not as noticeable in the process according to the present invention as in oxygen bleaching in the presence of sodium hydroxide.

The cellulose pulp may be pre-treated in a known manner to remove polyvalent metals and metal compounds which are catalytically active in the decomposition of carbohydrates, such as copper, iron, vanadium and cobalt compounds. The pre-treatment may be effected in an acid, neutral or alkaline medium. Aqueous solutions containing organic or inorganic acids such as acetic acid, citric acid, formic acid, hydrochloric acid, sulphuric acid, nitric acid and phosphoric acid can be used to advantage. Sulphurous acid can be used to particular advantage, as can also acid evaporation condensates and diluted washing liquors containing sulphite waste liquor.

The acid treatment can be at a pH within the range from about 1 to about 5, suitably from 1.5 to 4, preferably from 2 to 3.5, for a period of time from about 0.1 to about 10 hours. The treatment is normally effected at ambient temperature within the range from +10 to +±° C, but may also be effected at elevated temperatures, from about 35° to about 140° C, and in such cases can be combined with an acid pre-hydrolysis of the material in a known manner. A pre-hydrolysis, however, should be avoided with the majority of types of paper pulps. Consequently, the temperature and treatment periods during the pre-treatment process should in such cases be adjusted with respect to the pH of the pre-treatment liquid in a manner such that no depolymerisation, or only an insignificant depolymerisation, of the carbohydrate material is obtained.

This treatment process can be supplemented with or replaced by a treatment process using complexing agents for heavy metals, such as of the aforementioned types. The solution is normally removed by, for example, filtration and optionally washing, before the pulp is delignified and bleached.

The process of the invention is applicable to unbleached, partially bleached, or bleached cellulose pulps, prepared from any cellulose source such as straw, bagasse, or wood, by any pulping process, for example, soda pulp, sulfate pulp, sulfite pulp and semi-chemical pulp. The invention is especially applicable to cellulose pulps derived from wood, such as spruce pulp, pine pulp, hemlock pulp, birch pulp, fir pulp, cherry pulp, sycamore pulp, hickory pulp, ash pulp, beech pulp, poplar pulp, oak pulp, and chestnut pulp. The invention is particularly advantageous in the preparation of any pulp in which it is especially desired to avoid degradation of the cellulose during processing, such as most grades of paper pulp, and when it is desired to obtain a uniform controlled degradation, such as in the manufacture of viscose pulp of a desired viscosity.

In most cases where the starting cellulose pulp is free of lignin, or where the lignin content is low, either naturally so, or because it has been delignified, the process of the invention can be applied to remove hemicellulose, and/or cause oxidation of the cellulose, with a regulated diminution of the pulp viscosity.

The method has shown particularly favourable results with hardwood pulps, such as pulp from birch, aspen, beech and/or maple, but good results have also been obtained with bleaching sulphate pulps from softwood, e.g. spruce and/or pine. A much higher yield and a much higher viscosity is obtained, compared with oxygen-alkali delignification and bleaching effected in accordance with present-day techniques applied on an industrial scale.

The pulps produced in accordance with the invention can be used directly for the manufacture of different types and grades of paper. They also may be subjected to continued bleaching in accordance with known bleaching methods for the bleaching of oxygen-bleached pulp or for other cellulose pulps. A continued bleaching with oxygen-alkali may also be suitable.

The conditions concerning the pre-treatment of cellulose pulp and concerning the addition and quantities of different additives may be the same as those applied in previously proposed oxygen bleaching methods.

It has been found that suitable manganese compounds noticeably promote the selectivity during the process. This is particularly in the case when the pulp is pre-treated in a manner such that the content of active manganese compounds is lowered. Manganese salts in divalent form have been found very effective. Examples include manganese sulphate, manganese nitrate, manganese chloride and manganese acetate. The addition of manganese should be effected prior to beginning the oxygen delignification and bleaching process, although such additions can also be made during said process. The manganese compounds should be added to the system in an amount within the range from about 0.001 to about 2, suitably from about 0.01 to about 1, preferably from about 0.05 to about 0.5% calculated as Mn based on the dry weight of the pulp.

The manganese compound should provide manganese in catalytically active form to the delignification. For this purpose, the manganese should be preferably in a form which provides bivalent manganese. The anion with which the manganese ion is associated can be inorganic or organic, and the manganese can also be associated in a complex which provides a proportion of manganese.

Exemplary bivalent manganese compounds include manganous oxide, manganous chloride, manganous bromide, manganous hydroxide, manganous nitrite, manganous sulfate, manganous carbonate, manganous phosphate, manganous chlorate, manganous acetate, manganous formate, manganous oxalate, and complex salts of manganous ion with chelating inorganic and organic acids.

Aliphatic alpha-hydroxycarboxylic acids of the type RCHOHCOOH and the corresponding beta-hydroxycarboxylic acids $RCHOHCH_2COOH$ have the property of forming chelates with manganese.

Exemplary alpha- and beta-hydroxy carboxylic acids are glycolic acid, lactic acid, glyceric acid, $\alpha,\beta$-dihydroxybutyric acid, $\alpha$-hydroxybutyric acid, $\alpha$-hydroxyisobutyric acid, $\alpha$-hydroxy-n-valeric acid, $\alpha$-hydroxyisovaleric acid, $\beta$-hyroxyisobutyric acid, $\beta$-hydroxyisovaleric acid, erythronic acid, threonic acid, trihydroxyisobutyric acid, and sugar acids and aldonic acids, such as gluconic acid, galactonic acid, talonic acid, mannoic acid, arabonic acid, ribonic acid, xylonic acid, lyxonic acid, gulonic acid, idonic acid, altronic acid, allonic acid, ethenyl glycolic acid, and $\beta$-hydroxyisocrotonic acid.

Also useful are organic acids having two or more carboxylic groups, and no or from one to ten hydroxyl groups, such as oxalic acid, malonic acid, tartaric acid, malic acid, and citric acid, ethyl malonic acid, succinic acid, isosuccinic acid, glutaric acid, adipic acid, subertic acid, azelaic acid, maleic acid, fumaric acid, glutaconic acid, citramalic acid, trihydroxy glutaric acid, tetrahydroxy adipic acid, dihydroxy maleic acid, mucic acid, mannosaccharic acid, idosaccharic acid, talomucic acid, tricarballylic acid, aconitic acid, and dihydroxy tartaric acid.

Manganese complexes of nitrogen-containing polycarboxylic acids are especially effective inhibitors. Several important acids belonging to this group have the formula:

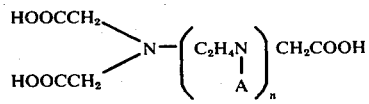

or alkali metal salts thereof, in which A is the group — $CH_2COOH$ or — $CH_2CH_2OH$, where n is an integer from zero to five. The mono, di, tri, tetra, penta and higher alkali metal salts are useful, according to the available carboxylic acid groups converted to alkali metal salt form.

Examples of such compounds are ethylene diamine tetraacetic acid, ethylene diamine triacetic acid, nitrilotriacetic acid, diethylene-triaminopentaacetic acid, tetraethylenepentamine heptaacetic acid, and hydroxyethylene diamine triacetic acid, and their alkali metal salts, including the mono, di, tri, tetra and penta sodium, potassium and lithium salts thereof. Other types of aminocarboxylic acids which can be used to advantage are iminodiacetic acid, 2-hydroxyethyliminodiacetic acid, cyclohexanediamine tetraacetic acid, anthranil-N,N-diacetic acid, and 2-picolylamine-N,N-diacetic acid.

These complexing agents can be present in rather large quantities, within the range from about one to about ten moles per equivalent of manganese. The use of waste pulping or bleaching liquor in combination with complexing agents of this type is particularly advantageous.

The polyphosphoric acids are also good complexing agents for manganese, and the manganese salts of these acids ae useful in the process of the invention. Exemplary are disodium manganous pyrophosphate, trisodium manganous tripolyphosphate and manganous polymetaphosphate.

Especially advantageous from the standpoint of cost are the acids naturally present in waste liquors obtained from the alkaline treatment of cellulosic materials. These acids represent the alkali- or water-soluble degradation products of polysaccarides which are dissolved in such liquors, as well as alkali- or water-soluble degradation products of cellulose and hemicellulose. The chemical nature of these degradation products are complex, and they have not been fully identified. However, it is known that saccharinic and lactic acids are present in such liquors, and that other hydroxy acids are also present. The presence of $C_6$-isosaccharinic and $C_6$-metasaccharinic acids has been demonstrated, as well as $C_4$- and $C_5$ metasaccharinic acids. Glycolic acid and lactic acid are also probable degradation products derived from the hemicelluloses, together with beta-gamma-dihydroxy butyric acid.

Carbohydrate acid-containing cellulose waste liquors which can be used include the liquors obtained from the hot alkali treatment of cellulose; liquors from sulfite digestion processes; and liquors from sulfate digestion processes, i.e., Kraft waste liquor. The waste liquors obtained in alkaline oxygen gas bleaching processes, for example, those disclosed in U.S. Pat. Nos. 3,652,385 and 3,652,386, or alkaline peroxide bleaching processes can also be used. In this instance, the alkaline liquor can be taken out from the process subsequent to completing the oxygen gas delignification or during the actual delignification process.

The complex manganese salts can be formed first, and then added to the cellulose pulp. They can also be formed in situ from a water-soluble or water-insoluble manganous salt, oxide or hydroxide, in admixture with the complexing acid, and this mixture can be added to the delignification liquor. Preferably, the waste liquor employed as the source of complexing acid or lactone or salt thereof can be mixed with a manganous salt, oxide or hydroxide, before being introduced to the process. It is also possible to add the manganous salt, oxide or hydroxide to the delignification liquor, and then bring the liquor into contact with the complexing acid or lactone or salt thereof. It is also possible to combine the complexing acid or lactone or salt thereof with the liquor and then add the manganous salt, oxide or hydroxide, but this method may be less advantageous in practice.

Manganese compounds providing manganese ion in a higher valence state, such as trivalent or tetravalent manganese, can be used, but may lead to the production of pulp having an impaired brightness. Exemplary higher polyvalent manganese compounds include manganic chloride, manganic nitrite, manganic sulfate, manganic carbonate, manganic acetate, manganic formate and manganic oxide, and complex salts of manganic ion with any of the chelating acids mentioned above.

Preferred embodiments of the delignification process of the invention and of the cellulose pulps of the invention are shown in the following Examples.

EXAMPLES 1 to 7

A technical birch sulphate pulp having a Kappa number of 20.2 and a viscosity of 1236 $cm^3/g$ was oxygen-bleached in accordance with the invention. The pulp was impregnated with aqueous sodium carbonate solution of a concentration adapted to obtain the percentage of active alkali given in the Table, and pressed to obtain a pulp consisting of 24 – 28%. The temperature of the impregnated pulp was 40° C. The pulp was fed to an absorption zone in a pressure vessel, and was treated with a mixture of oxygen and carbon dioxide gas taken from an oxygen-alkali bleaching process, the temperature of the gas being 129° C, and the gas having a total pressure of 10 bars, a partial pressure of carbon dioxide of 0.3 bar, and a partial pressure of oxygen of 6 bars.

The treatment was carried out for 5 minutes, during which time the temperature of the cellulose pulp rose to 92° C. Approximately 90% of the carbon dioxide charged to the absorption zone was absorbed, and the sodium carbonate was converted practically quantitatively to sodium bicarbonate. The content of bicarbonate, calculated on air-dry pulp, is given in the Table below.

The treated cellulose pulp was then bleached with oxygen in a rotatable reactor at 120° C, in which reactor the pulp was tumbled slowly by rotation of the reactor. The ingoing gas had a partial pressure of oxygen of 6.3 bars, and a partial pressure of carbon dioxide of 0.03 bar. During the treatment, which in different runs was continued for from 30 to 120 minutes, the oxygen gas was flowed through the reactor. The rate of flow was adjusted so that the partial pressure of the carbon dioxide in the outgoing gas was maintained at 0.3 bar during the first half of the bleaching treatment, and at 0.1 bar during the latter part of the treatment.

The results obtained are shown in Table I, in which Table the results for five controls using conventional oxygen-alkali bleaching with sodium hydroxide in the presence of magnesium complexed with a cellulose bleaching waste liquor are also given for comparison.

TABLE 1

| | Pulp consistency % | Temp. ° C. | Time Min | Alkali[1] % | Kappa No (SCAN) | Viscosity $cm^3/g$ (SCAN) | Brightness % (SCAN) | Yield loss % |
|---|---|---|---|---|---|---|---|---|
| Control | | | | NaOH | | | | |
| A | 28.1 | 100 | 30 | 2.5[2] | 11.4 | 983 | 53.8 | 3.6 |
| B | 28.1 | 100 | 30 | 3.0[2] | 11.3 | 973 | 53.5 | 3.4 |
| C | 28.1 | 100 | 30 | 3.5[2] | 11.1 | 940 | 54.3 | 3.7 |
| D | 28.0 | 110 | 30 | 4.0[2] | 10.6 | 878 | 56.3 | 4.9 |
| E | 28.0 | 110 | 30 | 5.0[2] | 10.3 | 823 | 57.8 | 5.3 |
| F | 28.0 | 100 | 30 | 2.5 | 11.2 | 903 | 54.0 | 4.0 |
| G | 28.2 | 100 | 30 | 3.1 | 11.0 | 890 | 54.5 | 3.8 |
| H | 28.1 | 100 | 30 | 3.5 | 11.0 | 870 | 54.8 | 4.2 |
| I | 28.2 | 110 | 30 | 4.0 | 10.3 | 782 | 55.9 | 4.9 |
| J | 28.0 | 110 | 30 | 5.0 | 9.9 | 713 | 58.6 | 6.0 |
| Example No. | | | | $NaHCO_3$ | | | | |
| 1 | 25.6 | 120 | 60 | 4.0 | 10.8 | 1019 | 54.7 | 3.1 |
| 2 | 26.0 | 120 | 60 | 5.0 | 10.4 | 980 | 56.1 | 3.2 |
| 3 | 26.1 | 120 | 60 | 5.0[2] | 11.8 | 1084 | 53.9 | 2.5 |
| 4 | 24.0 | 120 | 60 | 5.0 | 11.6 | 1044 | 53.3 | 2.5 |
| 5 | 24.0 | 120 | 120 | 5.0 | 9.5 | 923 | 61.1 | 3.6 |
| 6 | 23.7 | 120 | 120 | 5.0[2] | 9.8 | 953 | 60.6 | 2.7 |
| 7 | 27.8 | 120 | 90 | 5.4 | 9.8 | 953 | 58.6 | 3.1 |

[1]Calculated in percent by weight on the dry weight of the pulp
[2]these tests were carried out in the presence of a magnesium complex with 0.2% Mg.

As the results for Examples 1 to 7 show despite the fact that the control runs contained magnesium complexes as degradation inhibitors and the Examples did not, use of sodium bicarbonate and maintenance of $CO_2$ partial pressure within the stated range gives pulp having a much higher viscosity and a much lower yeild loss compared at the same delignification degree (in the Table reported as Kappa number according to SCAN). In the controls F to J, in which the magnesium addition was omitted, the pulps had a viscosity which when compared at the same Kappa number was 70–90 units lower than that obtained in Controls A to E, in the presence of magnesium.

The results show that the magnesium inhibitor contributes less when $NaHCO_3$ is used as the alkali than in conventional oxygen bleaching methods using sodium hydroxide as an active alkali. Thus, sodium bicarbonate makes it possible to omit the magnesium inhibitor, and still obtain a much improved yield, and a higher viscosity (less degradation of the carbohydrates), compared at the same lignin content.

EXAMPLES 8 to 14

A technical birch sulphate pulp having a Kappa number of 20.2 and a viscosity of 1236 $cm^3/g$ was oxygen-bleached in accordance with the invention. The pulp was impregnated with aqueous carbonate solution of a concentration adapted to obtain the percentage of active alkali given in the Table, containing 0.2% EDTA (calculated as the disodium salt, on the dry weight of the pulp) and pressed to obtain a pulp consistency of 24–28%. The temperature of the impregnated pulp was 40° C. The pulp was fed to an absorption zone in a pressure vessel, and was treated with a mixture of oxygen and carbon dioxide gas taken from an oxygen-alkali bleaching process, the temperature of the gas being 120° C, and the gas having a total pressure of 10 bars, a partial pressure of carbon dioxide of 0.3, and a partial pressure of oxygen of 6 bars.

The treatment was carried out for 5 minutes, during which time the temperature of the cellulose pulp rose to 92° C. Approximately 90% of the carbon dioxide charged to the absorption zone was absorbed, and the sodium carbonate was converted practically quantitatively to sodium bicarbonate. The content of bicarbonate, calculated on air-dry pulp, is given in the Table below.

The treated cellulose pulp was then bleached with oxygen in a rotatable reactor at 120° C, in which reactor the pulp was tumbled slowly by rotation of the reactor. The ingoing gas had a partial pressure of oxygen of 6.3 bars, and a partial pressure of carbon dioxide of 0.03 bar. During the treatment which in different runs was continued for from 30 to 120 minutes, the oxygen gas was flowed through the reactor. The rate of flow was adjusted so that the partial pressure of the carbon dioxide in the outgoing gas was maintained at 0.3 bar during the latter part of the treatment.

The results obtained are shown in Table II, in which Table the results for five controls using conventional oxygen-alkali bleaching with sodium hydroxide in the presence of magnesium complexed with a cellulose bleaching waste liquor are also given for comparison.

TABLE II

| | Pulp consistency % | Temp. ° C. | Time Min | Alkali[1] % | Kappa No (SCAN) | Viscosity $cm^3/g$ (SCAN) | Brightness % (SCAN) | Yield loss % |
|---|---|---|---|---|---|---|---|---|
| Control | | | | NaOH | | | | |
| A | 27.9 | 100 | 30 | 2.4[2] | 11.6 | 981 | 54.0 | 3.7 |
| B | 28.1 | 100 | 30 | 3.0[2] | 11.0 | 970 | 54.1 | 3.5 |
| C | 27.9 | 100 | 30 | 3.5[2] | 10.4 | 937 | 53.7 | 3.9 |
| D | 28.2 | 110 | 30 | 4.0[2] | 10.3 | 880 | 56.4 | 5.0 |
| E | 28.0 | 110 | 30 | 5.0[2] | 10.1 | 818 | 58.2 | 5.5 |
| F | 28.1 | 100 | 30 | 2.6 | 11.0 | 901 | 54.1 | 4.2 |
| G | 28.0 | 100 | 30 | 3.0 | 10.6 | 892 | 55.0 | 3.9 |
| H | 27.9 | 100 | 30 | 3.6 | 10.6 | 862 | 56.0 | 4.6 |
| I | 28.0 | 100 | 30 | 4.0 | 10.4 | 796 | 56.3 | 4.9 |
| J | 28.2 | 100 | 30 | 5.0 | 9.9 | 716 | 58.7 | 5.9 |
| Example No. | | | | $NaHCO_3$ | | | | |
| 8 | 28.2 | 100 | 60 | 4.2 | 10.6 | 1087 | 54.9 | 3.2 |
| 9 | 26.7 | 100 | 60 | 5.1 | 10.3 | 1078 | 56.3 | 3.2 |
| 10 | 26.1 | 100 | 60 | 5.0[2] | 10.6 | 1091 | 55.3 | 2.8 |
| 11 | 26.9 | 100 | 60 | 5.1[2] | 11.4 | 1123 | 53.8 | 2.5 |
| 12 | 26.9 | 100 | 120 | 5.0 | 9.6 | 1020 | 61.0 | 3.5 |
| 13 | 24.9 | 100 | 120 | 5.0[2] | 9.7 | 1038 | 60.2 | 2.7 |
| 14 | 26.5 | 100 | 90 | 5.6 | 9.6 | 1037 | 59.1 | 3.2 |

[1]Calculated in percent by weight on the dry weight of the pulp
[2]these tests were carried out in the presence of a magnesium complex with 0.2% Mg.

As the results for Examples 8 to 14 show despite the fact that the control runs contained magnesium complexes as degradation inhibitors and the Examples did not, use of sodium bicarbonate and maintenance of $CO_2$ partial pressure within the stated range gives pulp having a much higher viscosity and a much lower yield loss compared at the same delignification degree (in the Table reported as Kappa number according to SCAN). In the Controls F to J, in which the magnesium addition was omitted, the pulps had a viscosity which when compared at the same Kappa number was 64–141 units lower than that obtained in Controls A to E, in the presence of magnesium.

The results show that the magnesium inhibitor contributes less when $NaHCO_3$ is used as the alkali than in conventional oxygen bleaching methods using sodium hydroxide as an active alkali. Thus, sodium bicarbonate makes it possible to omit the magnesium inhibitor, and still obtain a much improved yield, and a higher viscosity (less degradation of the carbohydrates), compared at the same lignin content.

EXAMPLE 15

A technical pine sulphate pulp was delignified and bleached at a pulp concentration of 5% by forcing a gas containing oxygen at a total pressure of 12 bars through a suspension of the cellulose pulp in aqueous 0.1 M $NaHCO_3$ solution. As the sodium bicarbonate was consumed, additional sodium bicarbonate was added, so that the concentration was maintained within the range of 0.05 to 0.1 M $NaHCO_3$. The reaction temperature was maintained at 135° C.

The original pulp had a Kappa number of 33.6 and a viscosity of 1130 $cm^3/g$. At a partial pressure of carbon dioxide in the influent gas of 0.05 bar for one hour, and a partial pressure of 0.1 bar for one hour, there was obtained a Kappa number of 15.1 and a viscosity of 1010 $cm^3/g$.

In corresponding runs using a constant partial pressure of carbon dioxide of 2 bars, a reaction time of approximately 3 hours was required to obtain the Kappa number. The viscosity of the pulp was 920 $cm^3/g$, which was practically the same value as that obtained in conventional oxygen bleaching with sodium hydroxide as an active alkali, and with an addition of magnesium complex as a protector, in the same manner as in Examples 1 to 7.

The results show that a high $CO_2$ pressure slows down the delignification process, and impairs the selectivity, and that an extremely good selectivity can be obtained with pine sulphate pulps when the carbon dioxide partial pressure is maintained at a low level.

EXAMPLE 16

A technical sulphate pulp from pine with a viscosity of 1110 $cm^3/g$ and a Kappa number of 34.2 was delignified and bleached at 135° C, at a total pressure of 8 bars and at a pulp consistency of 12%. The bleaching liquor was aqueous 0.2 M $NaHCO_3$ solution. As sodium bicarbonate was consumed during the process the concentration was maintained constant by adding $NaHCO_3$.

In a control run in which pure oxygen was used, a Kappa number of 12 was obtained after 30 minutes. In a corresponding run using a carbon dioxide partial pressure of 1 bar, only 50 minutes were required to obtain this Kappa number. The viscosity in the latter case was 70 units ($cm^2/g$) higher, despite the longer duration of the bleaching.

In a third run, the sodium bicarbonate concentration in the liquor was lowered from 0.2 M at the beginning of the experiment to 0.1 M at the end. During the course of the experiment the partial pressure of the carbon dioxide was lowered continuously from 1 bar to 0.2 bars. A Kappa number of 12 was reached after 60 minutes. The viscosity was 120 units higher than in the control run referred to above (pure oxygen 0.2 M $NaHCO_3$) and 100 units higher than in a control run with pure oxygen in which the concentration of $NaHCO_3$ was permitted to drop from 0.2 M to 0.1 M.

These results show that with a high concentration of sodium bicarbonate, a higher carbon dioxide partial pressure should be employed than when a low sodium bicarbonate concentration is used (see Example 15). It is an advantage when using a high initial charge of sodium bicarbonate to allow the sodium bicabonate concentration to fall during the process, and important advantages are obtained if the carbon dioxide partial pressure is lowered at the same time.

Having regard to the foregoing disclosure, the following is claimed as the inventive and patentable embodiments thereof:

1. A process for delignifying and bleaching cellulose pulp with improved selectivity which comprises contacting and reacting cellulose pulp, in the absence of a magnesium protector, with oxygen gas in the presence of sodium bicarbonate, as the sole alkali, at an oxygen partial pressure of at least 1 bar at a temperature within the range from about 110° to about 170° C while removing carbon dioxide in an amount to maintain the partial pressure of carbon dioxide within the range from about 0.001 to about 3 bars.

2. A process according to claim 1 which comprises removing carbon dioxide formed during the process to maintain the carbon dioxide partial pressure within the range from about 0.03 to about 2 bars.

3. A process according to claim 1 which comprises removing carbon dioxide formed during the process to maintain the carbon dioxide partial pressure within the range from 0.05 to 0.5 bar.

4. A process according to claim 1 in which the partial pressure of oxygen is from about 3 to about 20 bars, and the partial pressure of carbon dioxide is from about 0.05 to about 1 bar.

5. A process according to claim 1 in which the pulp is a hardwood sulfate pulp and the carbon dioxide partial pressure is above 0.05 bar.

6. A process according to claim 1 in which the pulp is a sulphite pulp.

7. A process according to claim 1 in which the pulp is a softwood sulphate pulp.

8. A process according to claim 1, in which the first portion of the designification process is at a low carbon dioxide partial pressure within the range from 0.001 to 0.1 bar, and the pressure during the latter portion of the process is allowed to rise to from 0.1 to 0.5 bar.

9. A process according to claim 1, in which the course taken by the delignification and bleaching is monitored from determination of the carbon dioxide content or the partial pressure of carbon dioxide.

10. A process according to claim 1 in which the cellulose pulp and the oxygen gas are mixed together.

11. A process according to claim 1 in which the cellulose pulp and the oxygen gas are flowed past each other concurrently or countercurrently.

12. A process according to claim 1 in which carbon dioxide is liberated in the course of the delignification and bleaching process, and removed from the system to maintain carbon dioxide partial pressure within the stated range by forming sodium bicarbonate in situ in cellulose pulp impregnated with an aqueous alkaline reacting solution.

13. A process according to claim 12, in which the aqueous alkaline reacting solution comprises a member selected from the group consisting of sodium carbonate and sodium hydroxide.

14. A process according to claim 13 in which the cellulose pulp after absorbing carbon dioxide from the gas phase is subjected to a delignification and bleaching according to claim 1.

15. A process according to claim 13 in which the pulp concentration of the impregnated cellulose pulp in the absorption zone is within the range from about 60%.

16. A process according to claim 13 in which the carbon dioxide is absorbed in an alkaline reacting liquor.

17. A process according to claim 16 in which the absorption liquor contains sodium bicarbonate and is used as a source of sodium bicarbonate in the process of claim 1.

18. A process according to claim 13 in which carbon dioxide removed from the oxygen gas phase is used for wet combustion of waste cellulose pulping liquor and a solution containing sodium carbonate and sodium bicarbonate is obtained.

19. A process according to claim 18, in which the solution obtained from the wet combustion process is as a source of sodium bicarbonate in the process of claim 1.

20. A process according to claim 1 in which the cellulose pulp is treated at a pulp consistency within the range from 18 to 60%.

21. A process according to claim 1 in which a metal complexing agent selected from the group consisting of nitrogen-containing polycarboxylic acids, amines, hydroxyl-containing amines, and polyphosphates is also present during the delignification and bleaching process.

22. A process according to claim 1 in which the cellulose pulp is pre-treated in a manner to remove polyvalent metal compounds selected from the group consisting of copper, iron, vanadium and cobalt compounds which promote the degradation of carbohydrates in the cellulose pulp.

23. A process according to claim 1 in which the cellulose pulp is contacted and reacted with the oxygen gas in the presence of a selectivity-promoting manganese compound.

* * * * *

UNITED STATES PATENT OFFICE

CERTIFICATE OF CORRECTION

Patent No. 4,016,029 Dated April 5, 1977

Inventor(s) Hans Olof Samuelson

It is certified that error appears in the above-identified patent and that said Letters Patent are hereby corrected as shown below:

| | | |
|---|---|---|
| [30] | : | "7403452" should be --74 03452-1-- |
| Column 1, line 13 | : | delete "e" |
| Column 2, line 7 | : | "of" second occurrence should be --or-- |
| line 48 | : | "termperature" should be --temperature-- |
| Column 5, line 41 | : | "silvers" should be --slivers-- |
| Column 6, line 11 | : | "100°" should be --110°— |
| line 42 | : | "unrealisitcally" should be --unrealistically -- |
| Column 9, line 11 | : | "os" should be —of— |
| line 42 | : | "effected" should be --affected-- |
| Column 10, line 41 | : | "etraacetic" should be --tetraacetic— |
| lines 56 & 57 | : | "α-hydrox-yisobutyric" should be --β-hydroxy-isobutyric— |
| line 68 | : | delete "malonic acid, tartaric acid" |
| Column 11, line 57 | : | "(DPTA)" should be --(DTPA)-- |
| line 67 | : | "(U.S. Pat." should be --(U.S. Pats.-- |

UNITED STATES PATENT OFFICE

CERTIFICATE OF CORRECTION

Patent No. 4,016,029 Dated April 5, 1977

Inventor(s) Hans Olof Samuelson

It is certified that error appears in the above-identified patent and that said Letters Patent are hereby corrected as shown below:

| | | |
|---|---|---|
| Column 12, line 24 | : | "$+\pm$°C" should be --+35°C-- |
| line 66 | : | "with" should be --when-- |
| Column 13, lines 67 & 68 | : | "suber-tic" should be --suber-ic-- |
| Column 14, line 43 | : | "ae" should be —are-- |
| line 51 | : | "polysaccarides" should be --polysaccharides— |
| Column 15, line 3 | : | "U.S. Pat. No." should be -- U.S. Pats. Nos. -- |
| line 32 | : | "oxide" should be —oxalate-- |
| Column 16, line 2 | : | "consisting" should be --consistency-- |
| Column 17, line 41 | : | insert --sodium-- after "aqueous" |
| Column 19, line 7 | : | insert --same-- before "Kappa" |
| Column 20, line 19 | : | "disignification" should be --delignification— |

UNITED STATES PATENT OFFICE

CERTIFICATE OF CORRECTION

Patent No. 4,016,029 Dated April 5, 1977

Inventor(s) Hans Olof Samuelson

It is certified that error appears in the above-identified patent and that said Letters Patent are hereby corrected as shown below:

Column 20, line 52, before "60%" insert -- 18 to about --.

Signed and Sealed this twenty-sixth Day of July 1977

[SEAL]

Attest:

RUTH C. MASON
*Attesting Officer*

C. MARSHALL DANN
*Commissioner of Patents and Trademarks*